US011205366B2

(12) United States Patent
Huang

(10) Patent No.: US 11,205,366 B2
(45) Date of Patent: Dec. 21, 2021

(54) DRIVE CIRCUIT AND DISPLAY PANEL

(71) Applicants: CHONGQING HKC OPTOELECTRONICS TECHNOLOGY CO., LTD., Chongqing (CN); HKC CORPORATION LIMITED, Shenzhen (CN)

(72) Inventor: Xiaoyu Huang, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 449 days.

(21) Appl. No.: 16/313,137

(22) PCT Filed: Oct. 23, 2018

(86) PCT No.: PCT/CN2018/111365
§ 371 (c)(1),
(2) Date: Dec. 25, 2018

(87) PCT Pub. No.: WO2020/051995
PCT Pub. Date: Mar. 19, 2020

(65) Prior Publication Data

US 2021/0225244 A1 Jul. 22, 2021

(30) Foreign Application Priority Data

Sep. 11, 2018 (CN) ..... 201821479849.1

(51) Int. Cl.
*G09G 3/36* (2006.01)
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2300/0452* (2013.01)

(58) Field of Classification Search
CPC .. G09G 3/2003; G09G 3/2074; G09G 3/3677; G09G 3/3225; G09G 3/3233;
(Continued)

(56) References Cited

U.S. PATENT DOCUMENTS

2011/0285930 A1* 11/2011 Kimura ..... G09G 3/3648 349/43
2012/0086743 A1* 4/2012 Shiomi ..... G09G 3/3659 345/694
(Continued)

FOREIGN PATENT DOCUMENTS

CN 101178872 A 5/2008
CN 103325340 A 9/2013
(Continued)

OTHER PUBLICATIONS

Qi Shu, the ISA written comments, dated Jun. 2019, CN.

*Primary Examiner* — Jennifer T Nguyen

(57) ABSTRACT

This application discloses a drive circuit and a display panel. The drive circuit includes a plurality of pixels, where the pixel includes a first subpixel and a second subpixel; and a switching circuit, where the first subpixel and the second subpixel are respectively connected to ground through the switching circuit.

19 Claims, 4 Drawing Sheets

(58) Field of Classification Search
CPC ..... G09G 2300/0452; G09G 3/3648; G09G 2310/0248; G09G 2310/0264; G09G 2310/08; G09G 2310/0202
USPC ..... 345/76, 88, 98, 100
See application file for complete search history.

(56) References Cited

U.S. PATENT DOCUMENTS

| | | | | |
|---|---|---|---|---|
| 2013/0258224 | A1* | 10/2013 | Park | G02F 1/1368 349/41 |
| 2014/0159798 | A1* | 6/2014 | Duan | G09G 3/3677 327/434 |
| 2014/0218347 | A1* | 8/2014 | Lee | G09G 3/3614 345/211 |
| 2020/0242997 | A1* | 7/2020 | Xue | G09G 3/2092 |

FOREIGN PATENT DOCUMENTS

| | | | |
|---|---|---|---|
| CN | 105355180 | A | 2/2016 |
| CN | 105761704 | A | 7/2016 |
| CN | 106847177 | A | 6/2017 |
| CN | 109215577 | A | 1/2019 |

* cited by examiner

DRIVE CIRCUIT AND DISPLAY PANEL

This application claims priority to Chinese Patent Application No. CN201821479849.1, filed with the Chinese Patent Office on Sep. 11, 2018 and entitled "DRIVE CIRCUIT AND DISPLAY PANEL", which is incorporated herein by reference in its entirety.

TECHNICAL FIELD

This application relates to the field of display technologies, and in particular, to a drive circuit and a display panel.

BACKGROUND

Statement herein merely provides background information related to this application and does not necessarily constitute the prior art.

With the development and progress of technologies, a liquid crystal display has hot spots such as a thin body, a power saving feature, and low radiation, and therefore becomes a mainstream product of displays and is widely applied. Most of liquid crystal displays on the market are backlight-type liquid crystal displays, including liquid crystal panels and backlight modules. A working principle of a liquid crystal panel is placing liquid crystal molecules between two parallel glass substrates and applying a drive voltage to the two glass substrates to control a rotation direction of the liquid crystal molecules, to refract light of the backlight module to generate a picture.

An organic light-emitting diode (OLED) is a front technology of current panel display and has become an important research direction in modern IT and video products. A main drive principle of the OLED is: A system mainboard connects an R/G/B compressed signal, a control signal, and a power source to a connector on a PCB board through a wire, and after being processed by a timing controller (TCON) IC on the PCB board, the data is connected to a display area via the PCB board and through a Source-Chip on Film (S-COF) and a Gate-Chip on Film (G-COF), so that a screen displays and obtains needed power sources and signals.

Due to self-illumination characteristics of the OLED, the same picture is displayed for a long time, and consequently, attenuation speeds of material characteristics of corresponding pixels are different from those of remaining pixels. As a result, when the same current is input, display brightness of the two types of pixels is different, and a mark that cannot be removed is displayed, that is, "screen burn-in" occurs. "Screen burn-in" needs to be immediately resolved by a person skilled in the art.

SUMMARY

In view of the defect of the foregoing exemplary technology, this application provides a drive circuit and a display panel that attenuate "screen burn-in".

To achieve the foregoing objective, this application provides a drive circuit, comprising:

a plurality of pixels, wherein the pixel comprises a first subpixel and a second subpixel; and a switching circuit, wherein the first subpixel and the second subpixel are respectively connected to ground through the switching circuit.

In the solutions of this application, because the switching circuit is added, and the switching circuit can control the first subpixel and the second subpixel to be switched and connected to the ground. The first subpixel and the second subpixel can be made to be connected to the ground at an interval of a time period by controlling working of the switching circuit, to avoid that the first subpixel or the second subpixel displays the same picture for a long time, to prevent the first subpixel and the second subpixel from being damaged, to avoid occurrence of the problem "screen burn-in". In addition, the switching circuit can control at most one of the first subpixel and the second subpixel to be connected to the ground and therefore does not obviously affect display of the display panel. Besides, because the first subpixel and the second subpixel are independent of each other, when the first subpixel or the second subpixel is connected to the ground, resolution of the display panel is not reduced, thereby ensuring a display effect.

BRIEF DESCRIPTION OF DRAWINGS

The included accompanying drawings are used to provide further understanding of the embodiments of this application, constitute a part of the specification, illustrate implementations of this application, and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION

Figure 1:
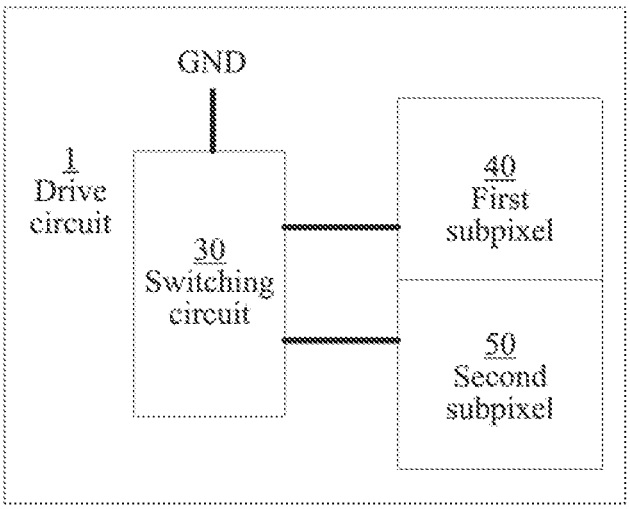
FIG. 1 is a schematic diagram of a drive circuit according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Hence, features defined by "first" or "second" may explicitly indicate or implicitly include one or more of the features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

This application is further described below with reference to the accompanying drawings and optional embodiments.

Figure 2:
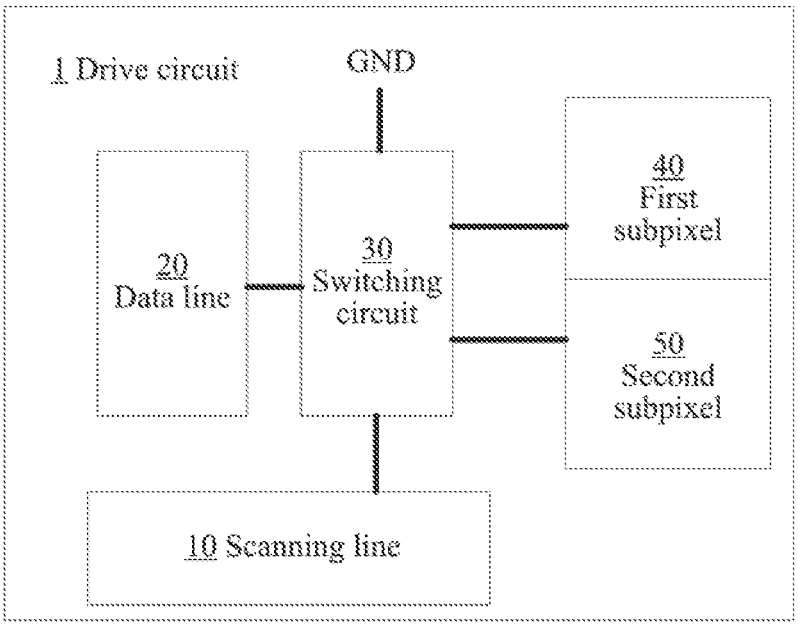
FIG. 2 is a schematic diagram of a drive circuit according to another embodiment of this application.
Figure 3:
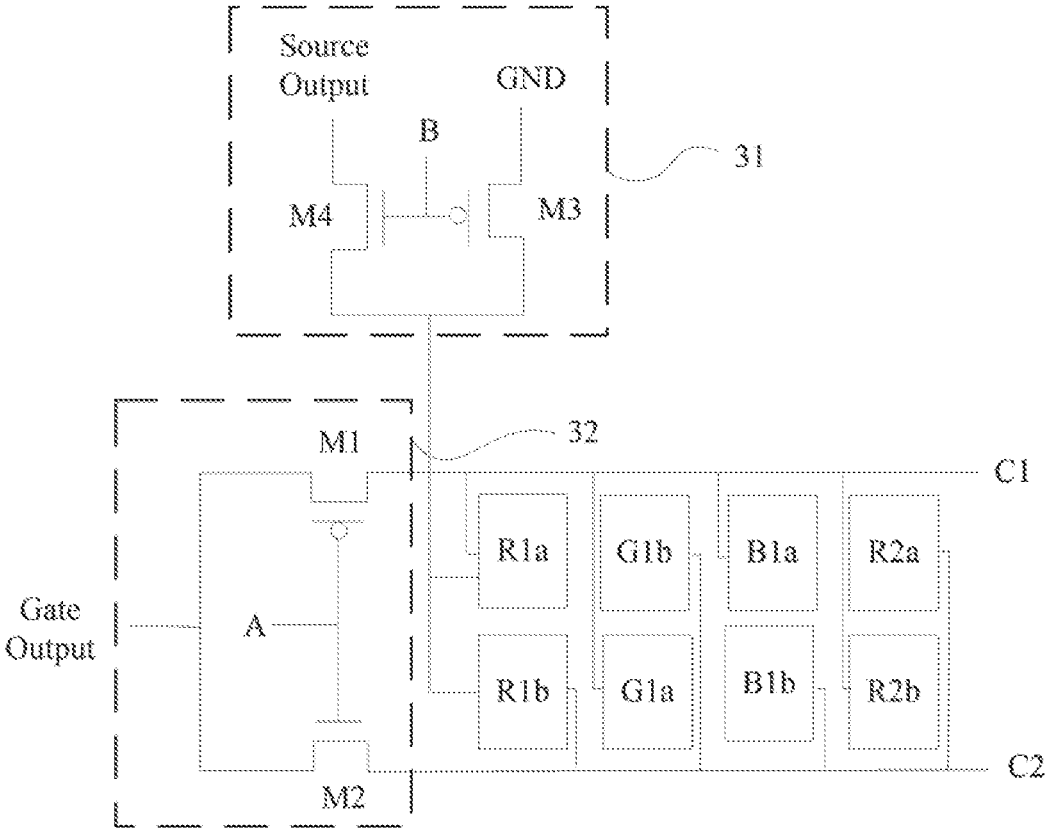
FIG. 3 is a circuit diagram of a drive circuit according to an embodiment of this application.
Figure 4:
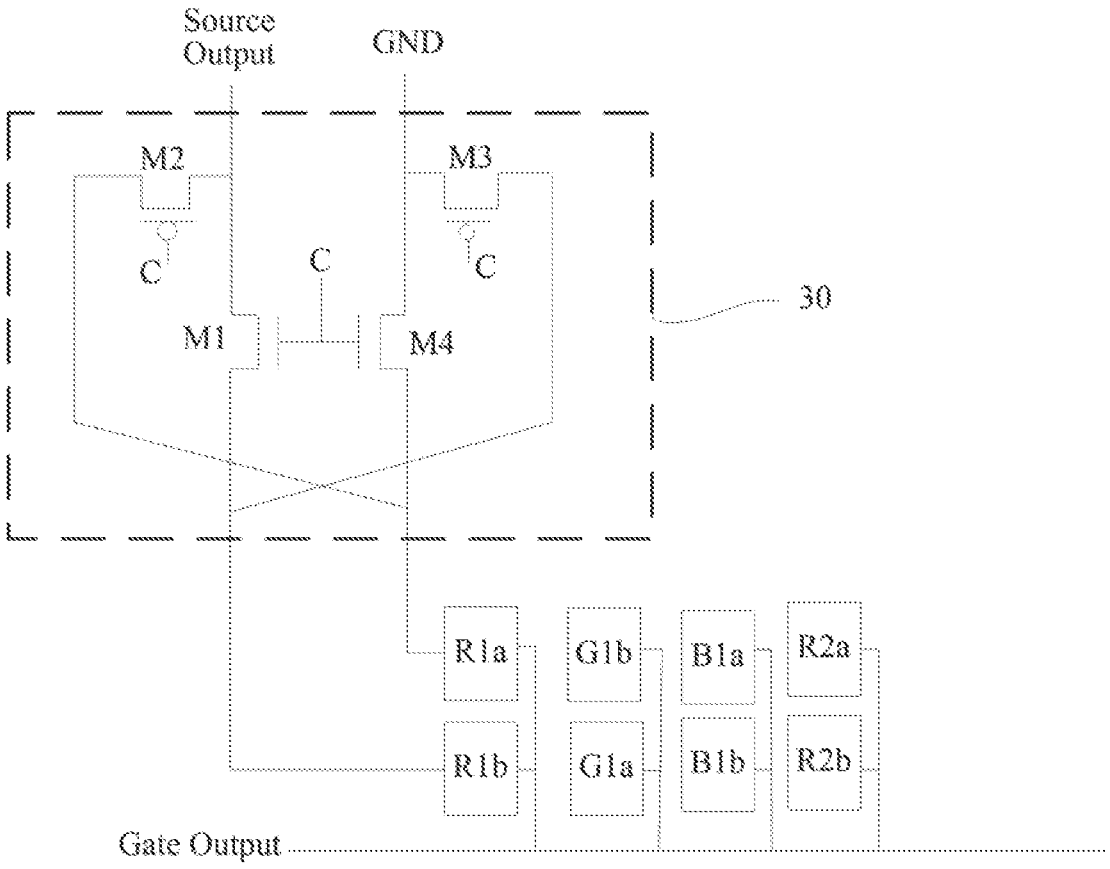
FIG. 4 is a circuit diagram of a drive circuit according to another embodiment of this application.

FIG. 1 is a schematic diagram of a drive circuit according to an embodiment of this application; FIG. 2 is a schematic diagram of a drive circuit according to another embodiment of this application; FIG. 3 is a circuit diagram of a drive circuit according to an embodiment of this application; FIG. 4 is a circuit diagram of a drive circuit according to another embodiment of this application. As shown in FIG. 1 to FIG. 4, an embodiment of this application discloses a drive circuit 1, including:

a plurality of pixels, where the pixel includes a first subpixel 40 and a second subpixel 50; and a switching circuit 30, where the first subpixel 40 and the second subpixel 50 are respectively connected to ground through the switching circuit 30.

The first subpixel 40 and the second subpixel are respectively connected to a scanning line 10 and a data line 20.

The display panel in this application includes a novel drive circuit. Because the switching circuit is added to the drive circuit, and the switching circuit can control the first subpixel and the second subpixel to be switched and connected to the ground. The first subpixel and the second subpixel can be made to be connected to the ground at an interval of a time period by controlling working of the switching circuit, to avoid that the first subpixel or the second subpixel displays the same picture for a long time, to prevent the first subpixel and the second subpixel from being damaged, to avoid occurrence of the problem "screen burn-in". In addition, the switching circuit can control at most one of the first subpixel and the second subpixel to be connected to the ground and therefore does not obviously affect display of the display panel. Besides, because the first subpixel and the second subpixel are independent of each other, when the first subpixel or the second subpixel is connected to the ground, resolution of the display panel is not reduced, thereby ensuring a display effect.

In this embodiment, optionally, the pixel further includes a third subpixel, a fourth subpixel, a fifth subpixel, and a sixth subpixel.

The first subpixel 40 and the second subpixel 50 are red subpixels; the third subpixel and the fourth subpixel are green subpixels, and the fifth subpixel and the sixth subpixel are blue subpixels.

In this solution, two subpixels are used as one pixel. For example, two red subpixels are used as one pixel for architecturing and are respectively connected to the ground through the switching circuit, and one or two of the two red subpixels may be controlled by the switching circuit to connect to both the scanning line and the data line. When necessary, the switching circuit is used to disconnect the first subpixel or the second subpixel from the scanning line and the data line and ground the first subpixel or the second subpixel, avoiding the problem "screen burn-in" due to displaying the same picture for a long time by the red subpixels. Certainly, the subpixels may also be green subpixels, blue subpixels, even white subpixels and yellow subpixels provided that they are applicable.

In this embodiment, optionally, the first subpixel 40 and the second subpixel 50 each include a red subpixel, a green subpixel, and a blue subpixel, and the red subpixel, the green subpixel, and the blue subpixel are respectively connected to the ground through the switching circuit 30.

In this solution, two subpixels are used as one pixel. For example, two red subpixels, two green subpixels, and two blue subpixels are used as one pixel for architecturing and are divided into two groups to be respectively connected to the ground through the switching circuit. One or two of the two subpixels may be controlled by the switching circuit to connect to both the scanning line and the data line. When necessary, one of the first subpixel and the second subpixel is controlled to disconnect from the scanning line and the data line and be connected to the ground, avoiding the problem "screen burn-in" due to displaying the same picture for a long time by the subpixels. Certainly, subpixels included in the subpixels are not necessarily in the same row. For example, pixels in a first row include a first red subpixel, a first green subpixel, and a first blue subpixel, pixels in a second row include a second red subpixel, a second green subpixel, and a second blue subpixel. The first subpixel may include the first red subpixel, the second subpixel, and the first subpixel, and the second subpixel may include the second red subpixel, the first subpixel, and the second subpixel. Certainly, other pixel architectures are also acceptable and are flexibly set according to an actual situation provided that they are applicable.

In this embodiment, optionally, the first subpixel 40 and the second subpixel 50 are respectively connected to the data line 20 through the switching circuit 30.

When the switching circuit 30 works, at least one of the first subpixel 40 and the second subpixel 50 is connected to the data line.

In this solution, the switching circuit not only controls the first subpixel and the second subpixel to be connected to the ground but also controls the first subpixel and the second subpixel to connect to the data line and the scanning line. The first subpixel and the second subpixel may be both connected to the data line, or one of the first subpixel and the second subpixel is connected to the data line, and the other is connected to the ground for switching. In either way, occurrence of the problem "screen burn-in" is effectively reduced.

Optionally, the switching circuit 30 includes a grounding switching circuit 31, the grounding switching circuit 31 includes a third switching transistor M3 and a fourth switching transistor M4, the third switching transistor M3 is a switching transistor whose control end is on with negative polarity, and the fourth switching transistor M4 is a switching transistor whose control end is on with positive polarity.

Gates of the third switching transistor M3 and the fourth switching transistor M4 are connected to each other and are connected to a grounding control signal B.

A source of the third switching transistor M3 is connected to the ground (GND), and a drain of the third switching transistor M3 is connected to source ends of the first subpixel 40 and the second subpixel 50.

A source of the fourth switching transistor M4 is connected to the data line 20, and a drain of the fourth switching transistor M4 is connected to the source ends of the first subpixel 40 and the second subpixel 50. Correspondingly, the drive circuit 1 includes a gate switching signal. A for controlling the gate switching circuit 32.

The switching circuit 30 further includes a gate switching circuit 32.

The gate switching circuit 32 includes a first switching transistor M1, a second switching transistor M2, a first storage capacitor C1, and a second storage capacitor C2, the first switching transistor M1 is a switching transistor whose control end is on with negative polarity, and the second switching transistor M2 is a switching transistor whose control end is on with positive polarity.

A source of the first switching transistor M1 is connected to the scanning line 10, and a drain of the first switching transistor M1 is connected to gate ends of the first storage capacitor C1 and the first subpixel 40.

A source of the second switching transistor M2 is connected to the scanning line 10, and a drain of the second switching transistor M2 is connected to gate ends of the second storage capacitor C2 and the second subpixel 50.

Gates of the first switching transistor M1 and the second switching transistor M2 are connected to each other and are connected to the gate switching signal A.

The scanning line 10 receives a gate switching signal Gate Output, and the data line 20 receives a data signal Source Output.

The switching transistor is generally a metal-oxide-semiconductor field effect switching transistor, that is, a metal oxide semiconductor (MOS) transistor. Certainly, the switching transistor may also be another component having similar functions. The switching transistor whose control end is on with positive polarity is a P-channel MOS transistor, that is, a P-MOS, and the switching transistor whose control end is on with negative polarity is an N-channel MOS transistor, that is, an N-MOS.

In this solution, the switching circuit further includes a third switching transistor and a fourth switching transistor that control connecting to the data line or connecting to the ground. The third switching transistor and the fourth switching transistor may be controlled by the grounding control signal to make, by coordinating the grounding control signal and the gate switching signal, the first subpixel or the second subpixel connected to the scanning line connect to the data line to normally display a picture. The second subpixel or the first subpixel disconnected from the scanning line may display a black picture by connecting to the ground when the scanning line is not connected. For example, it may be controlled that the first subpixel displays a normal picture in a first half of one frame of picture and displays a black picture in a second half, and the second subpixel may display a black picture in the first half of one frame of picture and display a normal picture in the second half. In this way, the first subpixel and the second subpixel may respectively experience a bright state and a dark state in each frame of picture, avoiding damage to the pixels due to displaying the same picture for a long time and finally avoiding screen burn-in.

Specifically, referring to FIG. 3, in an actual application, when a timing control chip (TCON) outputs a current frame of picture, in a first half of start time of each row, the gate switching signal A outputs a low level L, and the grounding control signal B outputs a high level H. In this case, the first switching transistor M1 and the fourth switching transistor M4 are opened, and the second switching transistor M2 and the third switching transistor M3 are closed. Pixels connected to the first storage capacitor C1 can be normally displayed. In a second half of start time of each row, the gate switching signal A outputs a high level H, and the grounding control signal B outputs a low level L. In this case, the first switching transistor M1 and the fourth switching transistor M4 are closed, the second switching transistor M2 and the third switching transistor M3 are opened, and pixels connected to pixels of the second storage capacitor C2 are connected to the ground (GND).

When the TCON outputs a next frame of picture, in a first half of start time of each row, the gate switching signal A outputs a low level L, and the grounding control signal B outputs a low level L. In this case, the first switching transistor M1 and the third switching transistor M3 are opened, and the second switching transistor M2 and the fourth switching transistor M4 are closed. Pixels connected to the first storage capacitor C1 are connected to the ground (GND) and therefore display a black picture. In a second half of start time of each row, the gate switching signal A outputs a high level H, and the grounding control signal B outputs a high level H. In this case, the first switching transistor M1 and the third switching transistor M3 are closed, the second switching transistor M2 and the fourth switching transistor M4 are opened, and pixels connected to the second storage capacitor C2 can be normally displayed.

Display pixels in the panel (red subpixels, green subpixels, blue subpixels, and red subpixels in the figure) are divided into a part a and a part b. A first red subpixel R1*a*, a first green subpixel G1*a*, a first blue subpixel B1*a*, and a fourth red subpixel R2*b* are connected to the first storage capacitor C1 corresponding to the first switching transistor M1, and a second red subpixel R1*b*, a second green subpixel G1*b*, a second blue subpixel B1*b*, and a third red subpixel R2*a* are connected to the second storage capacitor C2 corresponding to the second switching transistor M2.

In conclusion, each pixel experiences a bright state and a dark state at an interval of each frame, avoiding damage to the pixel due to displaying the same picture for a long time and finally avoiding screen burn-in.

In this embodiment, optionally, the switching circuit 30 further includes a gate switching circuit 32.

The first subpixel 40 and the second subpixel 50 are respectively connected to the scanning line 10 through the gate switching circuit 32.

When one of the first subpixel 40 and the second subpixel 50 is connected to the scanning line 10, the other is disconnected from the scanning line 10.

In this solution, the gate switching circuit 32 switches connecting the first subpixel 40 and the second subpixel 50. In this way, a scanning line 10 may be used to control working of subpixels in two rows.

In this embodiment, optionally, the switching circuit 30 includes a first switching transistor M1, a second switching transistor M2, a third switching transistor M3, and a fourth switching transistor M4.

The first switching transistor M1 and the fourth switching transistor M4 are switching transistors whose control ends are is on with positive polarity, and the second switching transistor M2 and the third switching transistor M3 are switching transistors whose control ends are on with negative polarity.

A source of the first switching transistor M1 is connected to the data line 20, and a drain of the first switching transistor M1 is connected to a source end of the first subpixel 40.

A source of the second switching transistor M2 is connected to the data line 20, a drain of the second switching transistor M2 is connected to the source end of the first subpixel 40, and a gate of the second switching transistor M2 is connected to a switching signal C.

A source of the third switching transistor M3 is connected to the ground (GND), and a drain of the third switching transistor M3 is connected to a source end of the second subpixel 50.

A source of the fourth switching transistor M4 is connected to the ground, a drain of the fourth switching transistor M4 is connected to the source end of the second subpixel 50, and a gate of the fourth switching transistor M4 is connected to the switching signal C.

Gates of the first switching transistor M1 and the fourth switching transistor M4 are connected to each other.

The scanning line 10 receives a gate switching signal Gate Output, and the data line 20 receives a data signal Source Output.

In this solution, the switching circuit includes the first switching transistor and the second switching transistor that control the first subpixel and the second subpixel to connect to the data line and also includes the third switching transistor and the fourth switching transistor that control connecting to the data line or connecting to the ground. Gates of the first switching transistor, the second switching transistor, the third switching transistor, and the fourth switching transistor are all connected to the switching signal. Because the first switching transistor and the fourth switching transistor are switching transistors whose control ends are is on with positive polarity, and the second switching transistor and the third switching transistor are switching transistors whose control ends are on with negative polarity, under control of the switching signal, one of the first subpixel and the second subpixel may be controlled to connect to the data line, and the other is connected to the ground. For example, it may be controlled that the first subpixel displays a normal picture in a first frame of two frames of picture and display a black picture in a second frame, and the second subpixel displays a normal picture in the second frame of two frames of picture and displays a black picture in the first frame. In this way, the first subpixel and the second subpixel may respectively experience a bright state and a dark state in each frame of picture, avoiding damage to the pixels due to displaying the same picture for a long time and finally avoiding screen burn-in.

Specifically, referring to FIG. 4, in an actual application, the switching signal C is a logic signal output by a timing control chip (TCON). The second switching transistor M2 and the third switching transistor M3 are switching transistors whose control ends are on with negative polarity, are opened when gate signals of the second switching transistor M2 and the third switching transistor M3 are at a low level L, and are closed when the gate signals of the second switching transistor M2 and the third switching transistor M3 are at a high level H. The first switching transistor M1 and the fourth switching transistor M4 are switching transistors whose control ends are is on with positive polarity, are opened when gate signals of the first switching transistor M1 and the fourth switching, transistor M4 are at a high level H, and are closed when the gate signals of the first switching transistor M1 and the fourth switching transistor M4 are at a low level L. The first switching transistor M1, the second switching transistor M2, the third switching transistor M3, and the fourth switching transistor M4 are located in a non-display area of a liquid crystal panel and are produced by sharing an existing array manufacture procedure. The scanning line 20 accepts a gate start signal Gate Output, and the gate start signal Gate Output is output by a gate driver chip (G-COF). The data line 10 accepts a data signal Source Output, and the data signal Source Output is a signal indicating that a data driver chip (S-COF) is output to a pixel electrode. Display pixels in the panel red subpixels R1, green subpixels G1, blue subpixels B1, and red subpixels R2 in the figure) are divided into a part a and a part b. The display pixels may include a first red subpixel R1*a* and a second red subpixel R1*b* or may respectively include a first red subpixel R1*a*, a first green subpixel G1*b*, and a first blue subpixel B1*a*, and a second red subpixel R1*b*, a second green subpixel G1*b*, and a second blue subpixel B1*b*.

Display pixels in the panel (red subpixels, green subpixels, blue subpixels, and red subpixels in the figure) are divided into a part a and a part b. A first red subpixel R1*a*, a first green subpixel G1*a*, a first blue subpixel B1*a*, and a fourth red subpixel R2*b* are connected to the first storage capacitor C1 corresponding to the first switching transistor M1, and a second red subpixel R1*b*, a second green subpixel G1*b*, a second blue subpixel B1*b*, and a third red subpixel R2*a* are connected to the second storage capacitor C2 corresponding to the second switching transistor M2.

When the TCON outputs a first frame of picture, the TCON outputs the switching signal C that is at a high level H. In this case, M1 and M4 are opened, and M2 and M3 are closed. In this case, Source Output is connected to B1, and the GND is connected to B2. In this case, R1*b* can normally display a corresponding picture output by the TCON, and R1*a* displays a black picture because R1*a* is connected to the GND.

When the TCON outputs a next frame of picture, the TCON outputs the switching signal C that is at a low level L. In this case, the second switching transistor M2 and the third switching transistor M3 are opened, and the first switching transistor M1 and the fourth switching transistor M4 are closed. In this case, the data line or Source Output is connected to the first subpixel, and the ground GND is connected to the second subpixel. In this case, the first red subpixel R1*a* can normally display a corresponding picture output by the ICON, and the second red subpixel R1*b* displays a black picture because the second red subpixel R1*b* is connected to the GND.

In conclusion, each pixel experiences a bright state and a dark state at an interval of every two frames, avoiding damage to the pixel due to displaying the same picture for a long time and finally avoiding screen burn-in.

In this embodiment, optionally, the drive circuit 1 further includes the scanning line 10, and the scanning line 10 is connected to gate ends of the first subpixel 40 and the second subpixel 50.

In this solution, by means of the switching circuit, when one scanning line is used, the scanning line may control working of the first subpixel and the second subpixel; the first subpixel and the second subpixel may be two subpixels in the same pixel or may be two adjacent pixel units.

Figure 5:
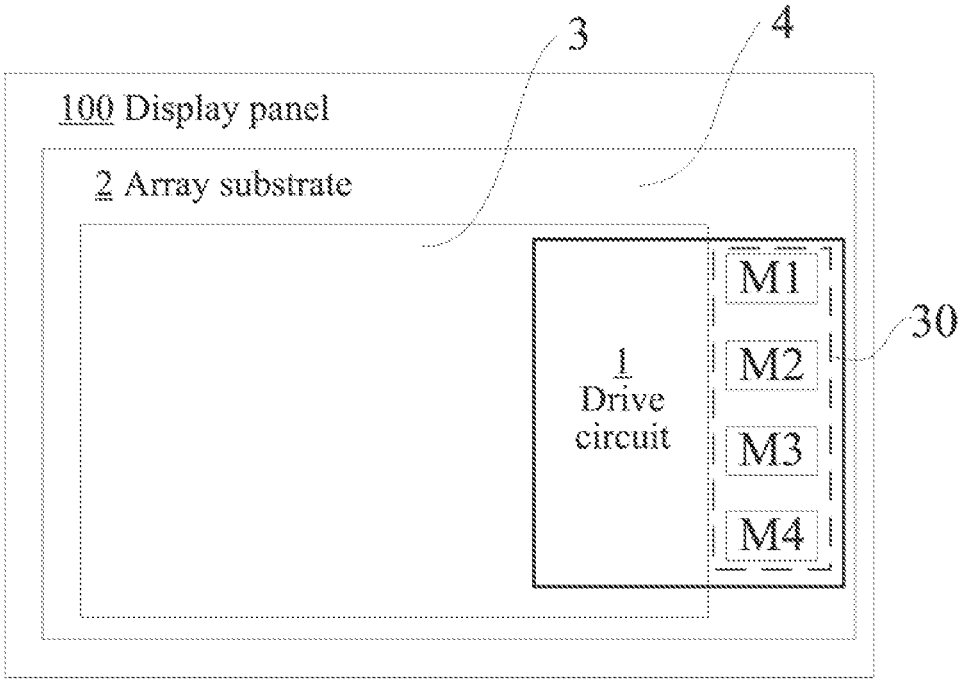
FIG. 5 is a schematic diagram of a display panel of this application.

FIG. 5 is a schematic diagram of a display panel in this application. Referring to FIG. 5, it can be learned with reference to FIG. 1 to FIG. 4 that this application also provides a display panel, including the drive circuit 1 as disclosed in this application.

The display panel 100 further includes an array substrate 2, where the array substrate 2 includes a display area 3 and a non-display area 4.

The switching circuit 30 is disposed in the non-display area 4.

The switching circuit 30 and the array substrate 2 are formed through a common array manufacture procedure.

Specifically, the switching circuit 30 may include at least one of a first switching transistor M1, a second switching transistor M2, a third switching transistor M3, and a fourth switching transistor M4.

the first switching transistor, the second switching transistor, the third switching transistor, the fourth switching transistor, and the array substrate are formed through a common array manufacture procedure.

The display panel in this application includes a novel drive circuit. Because the switching circuit is added to the drive circuit, and the switching circuit can control the first subpixel and the second subpixel to be switched and connected to the ground. The first subpixel and the second subpixel can be made to be connected to the ground at an interval of a time period by controlling working of the switching circuit, to avoid that the first subpixel or the second subpixel displays the same picture for a long time, to prevent the first subpixel and the second subpixel from being damaged, to avoid occurrence of the problem "screen burn-in". In addition, the switching circuit can control at most one of the first subpixel and the second subpixel to be connected to the ground and therefore does not obviously affect display of the display panel. Besides, because the first subpixel and the second subpixel are independent of each other, when the first subpixel or the second subpixel is connected to the ground, resolution of the display panel is not reduced, thereby ensuring a display effect.

The panel in this application is an OLED panel, may certainly be a twisted nematic (IN) panel, an in-plane switching (IPS) panel, or a multi-domain vertical alignment (VA) panel, or may certainly be any other suitable type of panel.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A drive circuit, comprising:

a plurality of pixels, wherein the pixel comprises a first subpixel and a second subpixel; and a switching circuit, wherein none or only one of the first subpixel or the second subpixel is connected to ground at the same time through the switching circuit;

wherein the first subpixel and the second subpixel are respectively connected to a data line through the switching circuit, and when the switching circuit works, at least one of the first subpixel and the second subpixel is connected to the data line at the same time;

wherein the switching circuit comprises a grounding switching circuit, the grounding switching circuit comprises a third switching transistor and a fourth switching transistor, the third switching transistor is a switching transistor whose control end is on with negative polarity, and the fourth switching transistor is a switching transistor whose control end is on with positive polarity; gates of the third switching transistor and the fourth switching transistor are connected to each other and are connected to a grounding control signal; a source of the third switching transistor is connected to the ground, and a drain of the third switching transistor is connected to source ends of the first subpixel and the second subpixel; and a source of the fourth switching transistor is connected to the data line, and a drain of the fourth switching transistor is connected to the source ends of the first subpixel and the second subpixel;

wherein the switching circuit further comprises a gate switching circuit; the first subpixel and the second subpixel are respectively connected to a scanning line through the gate switching circuit; and when one of the first subpixel and the second subpixel is connected to the scanning line, the other is disconnected from the scanning line; and wherein the drive circuit comprises a gate switching signal for controlling the gate switching circuit; the gate switching circuit comprises a first switching transistor, a second switching transistor, a first storage capacitor, and a second storage capacitor, the first switching transistor is a switching transistor whose control end is on with negative polarity, and the second switching transistor is a switching transistor whose control end is on with positive polarity; a source of the first switching transistor is connected to the scanning line, and a drain of the first switching transistor is connected to gate ends of the first storage capacitor and the first subpixel; a source of the second switching transistor is connected to the scanning line, and a drain of the second switching transistor is connected to gate ends of the second storage capacitor and the second subpixel; and gates of the first switching transistor and the second switching transistor are connected to each other and are connected to the gate switching signal.

2. The drive circuit according to claim 1, wherein the pixels further comprise a third subpixel, a fourth subpixel, a fifth subpixel, and a sixth subpixel; and the first subpixel and the second subpixel are red subpixels; the third subpixel and the fourth subpixel are green subpixels, and the fifth subpixel and the sixth subpixel are blue subpixels.

3. The drive circuit according to claim 2, wherein the first subpixel, the fourth pixel, and the fifth subpixel constitute a first group of subpixels, and wherein the second subpixel, the third subpixel, and the sixth subpixel constitute a second group of subpixels;

wherein the first subpixel, the third subpixel, and the fifth subpixel are sequentially arranged from left to right in a first row of subpixels, and wherein the second subpixel, the fourth subpixel, and the six subpixel are sequentially arranged from left to right in a second row of subpixel next to the first row;

wherein the drain of the first switching transistor that is coupled to the first storage capacitor is further connected to the gate end of each subpixel of the first group of subpixels, and the drain of the second switching transistor that is coupled to the second storage capacitor is further connected to the gate end of each subpixel of the second group of subpixels.

4. The drive circuit according to claim 1, wherein the first subpixel and the second subpixel each comprise a red subpixel, a green subpixel, and a blue subpixel, and the red subpixel, the green subpixel, and the blue subpixel are respectively connected to the ground through the switching circuit.

5. The drive circuit according to claim 4, wherein the red subpixel of the first subpixel, the green subpixel of the second subpixel, and the blue subpixel of the first subpixel are disposed in sequence from left to right in a first row of subpixels, and wherein the red subpixel of the second subpixel, the green subpixel of the first subpixel, and the blue subpixel of the second subpixel are disposed in sequence from left to right in a second row of subpixels next to the first row.

6. A display panel, comprising:

an array substrate, wherein the array substrate comprises a display area and a non-display area; and the drive circuit according to claim 1, wherein the switching circuit is disposed in the non-display area, and the switching circuit and the array substrate are formed through a common array manufacture procedure.

7. The display panel according to claim 6, wherein the pixels further comprise a third subpixel, a fourth subpixel, a fifth subpixel, and a sixth subpixel; and the first subpixel and the second subpixel are red subpixels; the third subpixel and the fourth subpixel are green subpixels, and the fifth subpixel and the sixth subpixel are blue subpixels.

8. The display panel according to claim 6, wherein the first subpixel and the second subpixel each comprise a red subpixel, a green subpixel, and a blue subpixel, and the red subpixel, the green subpixel, and the blue subpixel are respectively connected to the ground through the switching circuit.

9. A drive circuit, comprising:

a plurality of pixels, wherein the pixel comprises a first subpixel and a second subpixel; and a switching circuit, wherein none or only one of the first subpixel or the second subpixel is connected to ground at the same time through the switching circuit;

wherein the switching circuit comprises a first switching transistor, a second switching transistor, a third switching transistor, and a fourth switching transistor;

the first switching transistor and the fourth switching transistor are switching transistors whose control ends are is on with positive polarity, and the second switching transistor and the third switching transistor are switching transistors whose control ends are on with negative polarity;

a source of the first switching transistor is connected to a data line, and a drain of the first switching transistor is connected to a source end of the first subpixel;

a source of the second switching transistor is connected to the data line, a drain of the second switching transistor is connected to the source end of the first subpixel, and a gate of the second switching transistor is connected to a switching signal;

a source of the third switching transistor is connected to the ground, and a drain of the third switching transistor is connected to a source end of the second subpixel;

a source of the fourth switching transistor is connected to the ground, a drain of the fourth switching transistor is connected to the source end of the second subpixel, and a gate of the fourth switching transistor is connected to the switching signal; and gates of the first switching transistor and the fourth switching transistor are connected to each other.

10. The drive circuit according to claim 9, wherein the drive circuit further comprises a scanning line, and the scanning line is connected to gate ends of the first subpixel and the second subpixel.

11. The drive circuit according to claim 9, wherein the pixels further comprise a third subpixel, a fourth subpixel, a fifth subpixel, and a sixth subpixel; and the first subpixel and the second subpixel are red subpixels; the third subpixel and the fourth subpixel are green subpixels, and the fifth subpixel and the sixth subpixel are blue subpixels.

12. The drive circuit according to claim 11, wherein the first subpixel, the fourth pixel, and the fifth subpixel constitute a first group of subpixels, and wherein the second subpixel, the third subpixel, and the sixth subpixel constitute a second group of subpixels;

wherein the first subpixel, the third subpixel, and the fifth subpixel are sequentially arranged from left to right in a first row of subpixels, and wherein the second subpixel, the fourth subpixel, and the six subpixel are sequentially arranged from left to right in a second row of subpixel next to the first row.

13. The drive circuit according to claim 12, wherein the drive circuit further comprises a scanning line, which is connected to the gate end of each of the first to sixth subpixels.

14. A display panel, comprising:

an array substrate, wherein the array substrate comprises a display area and a non-display area; and the drive circuit according to claim 9, wherein the switching circuit is disposed in the non-display area, and the switching circuit and the array substrate are formed through a common array manufacture procedure.

15. The drive circuit according to claim 14, wherein the drive circuit further comprises a scanning line, and the scanning line is connected to gate ends of the first subpixel and the second subpixel.

16. The drive circuit according to claim 14, wherein the pixels further comprise a third subpixel, a fourth subpixel, a fifth subpixel, and a sixth subpixel; and the first subpixel and the second subpixel are red subpixels; the third subpixel and the fourth subpixel are green subpixels, and the fifth subpixel and the sixth subpixel are blue subpixels.

17. The drive circuit according to claim 16, wherein the first subpixel, the fourth pixel, and the fifth subpixel constitute a first group of subpixels, and wherein the second subpixel, the third subpixel, and the sixth subpixel constitute a second group of subpixels;

wherein the first subpixel, the third subpixel, and the fifth subpixel are sequentially arranged from left to right in a first row of subpixels, and wherein the second subpixel, the fourth subpixel, and the six subpixel are sequentially arranged from left to right in a second row of subpixel next to the first row.

18. The drive circuit according to claim 17, wherein the drive circuit further comprises scanning line, which is connected to the gate end of each of the first to sixth subpixels.

19. A drive circuit, comprising:

a plurality of pixels, wherein the pixel comprises a first subpixel, a second subpixel, a third subpixel, a fourth subpixel, a fifth subpixel, and a sixth subpixel; and the first subpixel and the second subpixel are red subpixels; the third subpixel and the fourth subpixel are green subpixels, and the fifth subpixel and the sixth subpixel are blue subpixels; and a switching circuit, wherein the first subpixel and the second subpixel are respectively connected to ground through the switching circuit, and when the switching circuit works, at least one of the first subpixel and the second subpixel is connected to a data line;

the switching circuit comprises a gate switching circuit, the gate switching circuit comprises a first switching transistor, a second switching transistor, a first storage capacitor, and a second storage capacitor, the first switching transistor is a switching transistor whose control end is on with negative polarity, and the second switching transistor is a switching transistor whose control end is on with positive polarity;

a source of the first switching transistor is connected to a scanning line, and a drain of the first switching transistor is connected to gate ends of the first storage capacitor and the first subpixel;

a source of the second switching transistor is connected to the scanning line, and a drain of the second switching transistor is connected to gate ends of the second storage capacitor and the second subpixel;

gates of the first switching transistor and the second switching transistor are connected to each other and are connected to a gate switching signal;

the switching circuit comprises a grounding switching circuit, the grounding switching circuit comprises a third switching transistor and a fourth switching transistor, the third switching transistor is a switching transistor whose control end is on with negative polarity, and the fourth switching transistor is a switching transistor whose control end is on with positive polarity;

gates of the third switching transistor and the fourth switching transistor connected to each other and are connected to a grounding control signal;

a source of the third switching transistor is connected to ground, and a drain of the third switching transistor is connected to source ends of the first subpixel and the second subpixel; and a source of the fourth switching transistor is connected to the data line, and a drain of the fourth switching transistor is connected to the source ends of the first subpixel and the second subpixel.

* * * * *